US007975349B2

(12) United States Patent
Broadhead et al.

(10) Patent No.: US 7,975,349 B2
(45) Date of Patent: Jul. 12, 2011

(54) PIVOTING, TRANSLATING AND LATCHING HINGE

(75) Inventors: Douglas G. Broadhead, Brampton (CA); Traian Miu, Oakville (CA)

(73) Assignee: Magna Closures Inc., Newmarket (CA)

( * ) Notice: Subject to any disclaimer, the term of this patent is extended or adjusted under 35 U.S.C. 154(b) by 77 days.

(21) Appl. No.: 12/040,939

(22) Filed: Mar. 3, 2008

(65) Prior Publication Data

US 2008/0222844 A1 Sep. 18, 2008

Related U.S. Application Data

(60) Provisional application No. 60/894,241, filed on Mar. 12, 2007.

(51) Int. Cl.
*E05D 11/10* (2006.01)

(52) U.S. Cl. ..... 16/346; 16/319; 16/333; 16/343

(58) Field of Classification Search ..... 16/366, 16/368, 369, 370, 291, 293, 297, 317, 319, 16/282, 287, 294, 302, 311, 343, 346, 230, 16/231, 371; 296/146.11, 146.12, 88; 292/303, 292/304, DIG. 23, DIG. 17
See application file for complete search history.

(56) References Cited

U.S. PATENT DOCUMENTS

| | | | | |
|---|---|---|---|---|
| 2,870,477 | A | 1/1959 | Anthony et al. | |
| 2,890,478 | A | 6/1959 | Young | |
| 3,408,100 | A | 10/1968 | McKey | |
| 4,719,665 | A * | 1/1988 | Bell | 16/232 |
| 5,062,182 | A * | 11/1991 | Griffiths et al. | 16/368 |
| 6,030,024 | A * | 2/2000 | Schmidhuber et al. | 296/146.12 |
| 6,038,738 | A | 3/2000 | Neag et al. | |
| 6,052,870 | A | 4/2000 | Hagenlocher et al. | |
| 6,591,452 | B2 * | 7/2003 | Jacquin | 16/332 |
| 6,842,945 | B2 * | 1/2005 | Hiramatsu | 16/366 |
| 6,942,277 | B2 * | 9/2005 | Rangnekar et al. | 296/146.11 |
| 7,032,953 | B2 * | 4/2006 | Rangnekar et al. | 296/146.11 |
| 7,096,538 | B2 | 8/2006 | Liang et al. | |
| 7,197,790 | B1 * | 4/2007 | Edmondson | 16/336 |
| 7,350,273 | B1 * | 4/2008 | Skipper | 16/366 |
| 7,416,229 | B2 * | 8/2008 | Stefanic | 292/216 |
| 2002/0166206 | A1 | 11/2002 | Spurr et al. | |
| 2005/0166363 | A1 | 8/2005 | Hoffmann | |
| 2005/0173943 | A1 * | 8/2005 | Duffy | 296/146.12 |
| 2005/0241105 | A1 * | 11/2005 | Wiley | 16/266 |

* cited by examiner

*Primary Examiner* — Thomas B Will
*Assistant Examiner* — Emily Morgan
(74) *Attorney, Agent, or Firm* — Magna International Inc; Alex Porat

(57) ABSTRACT

The invention is a hinge for a vehicle door that is movable between a closed and a fully open position relative to a vehicle body. The hinge includes a mounting bracket, operable to be secured to the vehicle body. At least one link is pivotally mounted along a fixed axis to the mounting bracket at a first end and operable to pivot a second end of the at least one link between a first and second position. A door bracket is operable to be secured to the vehicle door, and pivotally mounted along a movable axis to the second end of the at least one link. The vehicle door is constrained by the vehicle body from pivoting around the movable axis when the second end of the at least one link is in the first position, and is operable to pivot around the movable axis when the at least one link is in the second position. A latch is provided on the hinge, obviating the need for a separate door latch.

16 Claims, 7 Drawing Sheets

PIVOTING, TRANSLATING AND LATCHING HINGE

This application claims the benefit of U.S. Provisional Application No. 60/894,241, filed Mar. 12, 2007.

FIELD OF THE INVENTION

The present invention relates to hinges. More specifically, the present invention relates to hinges adapted for vehicle doors.

BACKGROUND OF THE INVENTION

The doors on most cars and trucks pivot on conventional hinges that pivot along a fixed axis. Brackets are attached to the internal sheet metal of the door and the vehicle body so that they are hidden from view when the door is closed. The two brackets are joined together by a common pin which defines the pivot point. The placement of the hinge limits the cut lines and overall shape of the door since the door must be able to pivot without interference. In addition, the arc of travel of the door while pivoting is similarly constrained. However, many vehicle designers today wish to be free from the limitations imposed by conventional hinges on door designs. It is thus desirable to provide a door hinge which can accommodate a greater range of door designs.

Conventional door design also places the door latch on the opposite side of the door from the hinges. While it is clearly mechanically advantageous to do so, this arrangement is not without its own disadvantages. The primary disadvantage is the requirement for a separate latch. Given the complexity of modern vehicle latches, this can be an expensive component. In addition, during a collision, traditional door latches are vulnerable to accidentally releasing, as inertial forces can spring open the ratchet and pawl, thereby releasing the vehicle door. It is thus desirable to provide a safer and less expensive door latch.

SUMMARY OF THE INVENTION

According to one aspect of the invention, an automotive door is provided in which the latch used to retain the door in the closed position is located on the hinged side of the door, and more particularly, forms a part of the hinge structure.

According to another aspect of the invention, a hinge is provided for an automotive door, which hinge has a pivot axis that moves in space, thereby enabling the vehicle door to be displaced from the vehicle body as the door opens or closes.

According to another aspect of the invention, there is provided a hinge for a vehicle door that is movable between a closed and a fully open position relative to a vehicle body. The hinge includes a mounting bracket, operable to be secured to the vehicle body. At least one link is pivotally mounted along a fixed axis to the mounting bracket at a first end and operable to pivot a second end of the at least one link between a first and second position. A door bracket is operable to be secured to the vehicle door, and pivotally mounted along a movable axis to the second end of the at least one link. The vehicle door is constrained by the vehicle body from pivoting around the movable axis when the second end of the at least one link is in the first position, and is operable to pivot around the movable axis when the at least one link is in the second position.

According to another aspect of the invention there is provided a hinge for a vehicle door that is movable between a closed and a fully open position relative to a vehicle body. The hinge includes a mounting bracket, operable to be secured to the vehicle body. At least one link is pivotally mounted along a fixed axis to the mounting bracket at a first end and operable to pivot a second end of the at least one link between a first and second position. A door bracket is operable to be secured to the vehicle door, and pivotally mounted along a movable axis to the second end of the at least one link. A ratchet and pawl are each pivotally mounted to the hinge, and cooperatively movable between an engaged and a released position and where the latch is operable to retain the hinge in the closed position while in the engaged position, and to permit the hinge to move to the open position when moved to the released position.

BRIEF DESCRIPTION OF THE DRAWINGS

Preferred embodiments of the present invention will now be described, by way of example only, with reference to the attached Figures, wherein.

DETAILED DESCRIPTION OF THE INVENTION

Figure 1A:
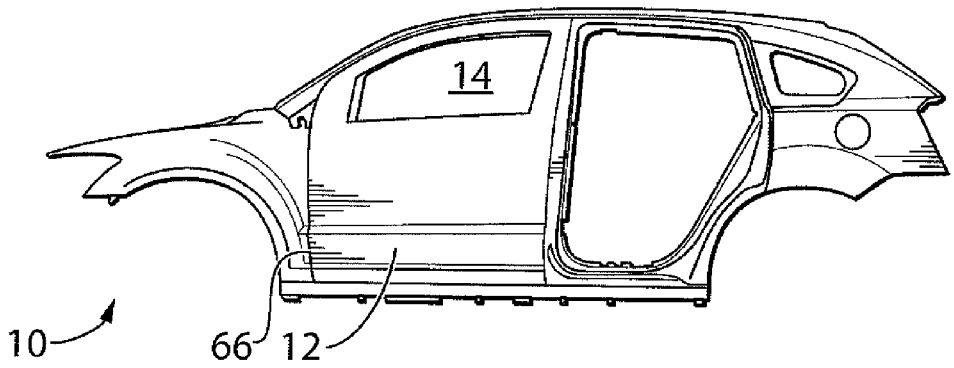
FIGS. 1A to 1C are partial side plan views of a vehicle door pivotally mounted to a vehicle in different positions of travel between an open and closed position using a pair of hinges in accordance with a first aspect of the invention.
Figure 1B:
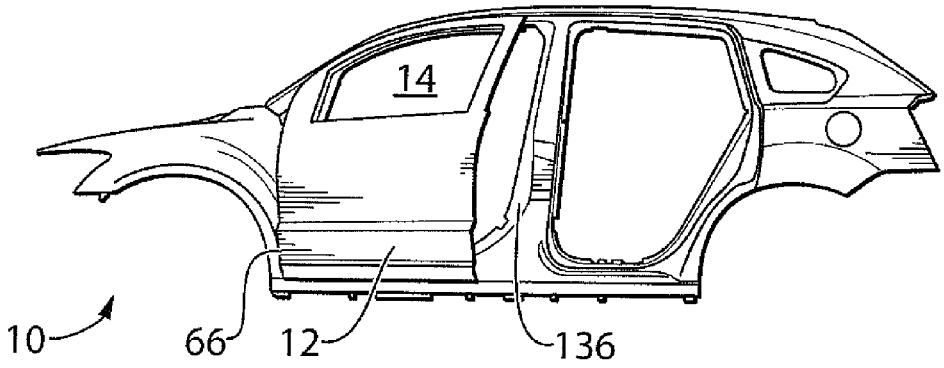
Figure 1C:
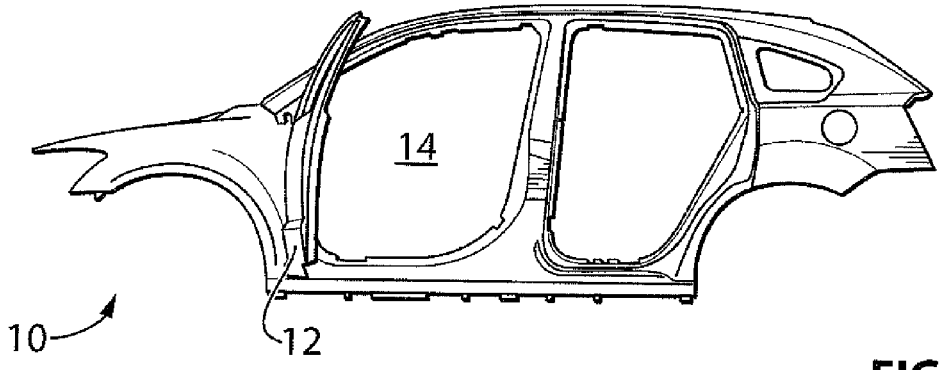

Referring now to FIGS. 1A-1C, a vehicle body 10 is provided having a front door 12 that provides access to an interior compartment 14. Door 12 moves between a closed position (FIG. 1A), a partially open position (FIG. 1B) and a fully open position (FIG. 1C). As can be more clearly seen in FIGS. 2A-2D, door 12 moves between the closed position and the open position on a pair of hinges 16. In the presently illustrated embodiment, the two hinges 16 are substantially identical. It is contemplated that a door 12 could move on a single hinge 16, particularly if vehicle body 10 is for a compact or subcompact car.

Referring now to FIGS. 3A and 3B and 4A to 4D, hinges 16 are shown in greater detail. Hinge 16 is operable to move between a closed position (FIG. 4A) and a fully open position (FIG. 4D) that correspond to the closed and fully open positions of door 12. Hinge 16 includes a mounting bracket 18 that is fixedly mounted to a sidewall 19 (FIG. 2B) on the vehicle body 10 so that mounting bracket 16 would be perpendicular to door 12 while the door is in the closed position. Apertures 20 are provided along base flanges 22 to locate fasteners such as bolts (not shown). Mounting bracket 18 further includes a body portion 24 that extends away from sidewall 19 and an extended portion 26 that is substantially parallel to mounting brackets 18 and forms a partially-open compartment 27 therebetween.

An outer bar 28 is pivotally mounted to mounting bracket 18 along a fixed first axis 30, and is movable between a first position close to vehicle body 10 and a second position where the bar is rotated away from vehicle body 10. Outer bar 28 is adapted to primarily bear the weight of door 12 includes a spaced apart pair of arms 32 that are connected to each other via structural web 34. A void 36 is provided between sections of structural web 34. Each arm 32 (which appears somewhat L-shaped in top profile) includes a first segment 37 that rests within compartment 27 when door 12 is in the closed position and a second segment 38 that is presented at an angle to first segment 37. A recessed cavity is provided (not shown) in sidewall 19 to extend the size of compartment 27 so that first segment 37 can be longer than body portion 24 and still rest within compartment 27 while hinge 16 is in the closed position.

An inner bar 40 is pivotally mounted to mounting bracket 18 along a second fixed axis 42 that is offset from first fixed axis 30 on extended portion 26. Inner bar 40 (which appears generally S-shaped in top profile) includes a spaced apart pair of arms 44. Inner bar 40 is located within void 36 so that its pivotal motion does not interfere with the pivotal motion of outer bar 28. A clasp 43 (FIG. 4B) is provided midway along the length of one of the arms 44 that latches around a post 45 on mounting bracket 18 when hinge 16 is in the closed position in order to prevent the hinge from accidentally moving to its open position.

A link bar 46 is also pivotally mounted to mounting bracket 18, along a third fixed axis 48 that is spaced closer to base flange 22 than first fixed axis 30 and second fixed axis 42. As with outer bar 28 and inner bar 40, link bar 46 includes a pair of spaced-apart, interconnected arms 47.

An auxiliary link bar 50 is pivotally connected at a first end 52 to the other end of link bar 46 along a movable fourth axis 54. The other end of inner bar 40 is also pivotally mounted to auxiliary link bar 50 along a fifth axis 56 that is located partially up the body of auxiliary link bar 50 from fourth axis 54.

A door bracket 58 is fixedly mounted to door 12 (FIG. 2) via a pair of adjustable fasteners 60, thereby attaching the door to hinge 16. Door bracket 58 is pivotally connected to the ends of outer bar 28 at a movable sixth axis 62 and is pivotally connected to auxiliary link bar 50 along a seventh axis 64.

As can be seen from FIGS. 2A to 2D and 4A to 4D, sixth axis 62 (which door 12 pivots around) is itself movable and pivots around first axis 30, which is fixed relative to the vehicle body 10. While in the closed position (FIG. 2A, 4A), hinge 16 is collapsed so that the sixth axis 62 (which pivotally connects door bracket 58 to outer bar 28) is roughly in line with second axis 42 (which pivotally connects mounting bracket 18 to inner bar 40), and is close to vehicle body 10. Clasp 43 is seated around post 45, helping to retain hinge 16 in the closed position. Opening the door (via manual opening or power release) causes outer bar 28 to pivot around the fixed first axis 30 from its first position to its second position, and the other linkages follow. As door 12 begins to pivot towards the open position, a forward edge 66 of the door is displaced away from vehicle body 10 (FIG. 2B, 4B) and forward relative to sidewall 19.

Figure 2A:
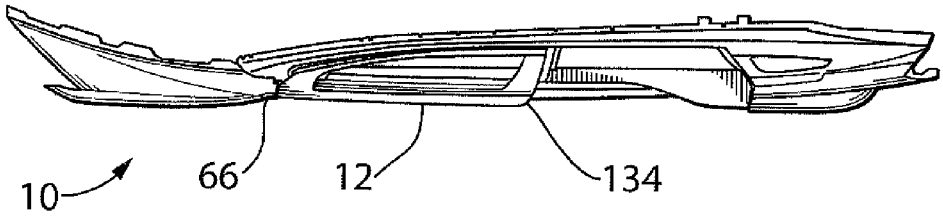
FIGS. 2A to 2D are partial top plan views of the vehicle door shown in FIG. 1 in different positions of travel between the open and closed positions.
Figure 2B:
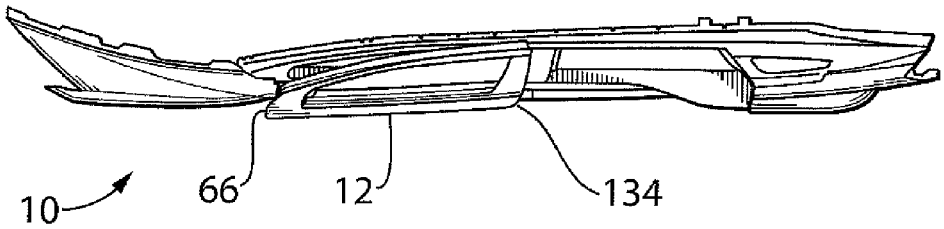
Figure 2C:
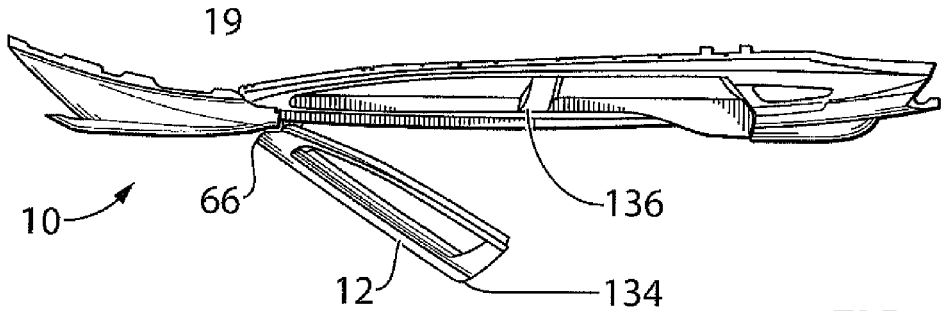
Figure 2D:
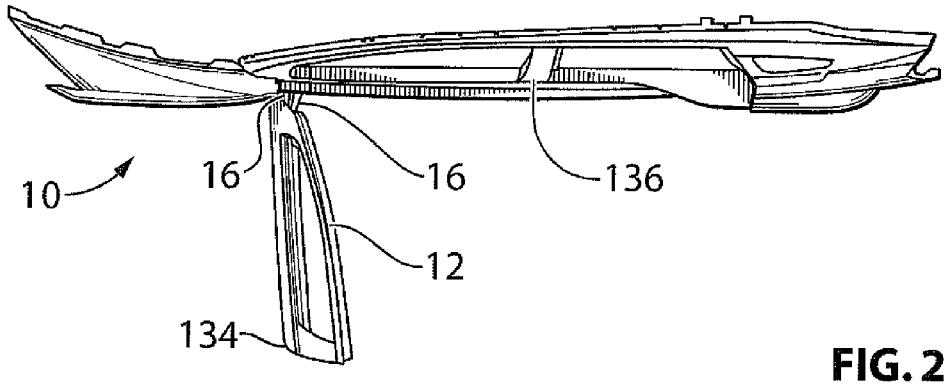
Figure 3A:
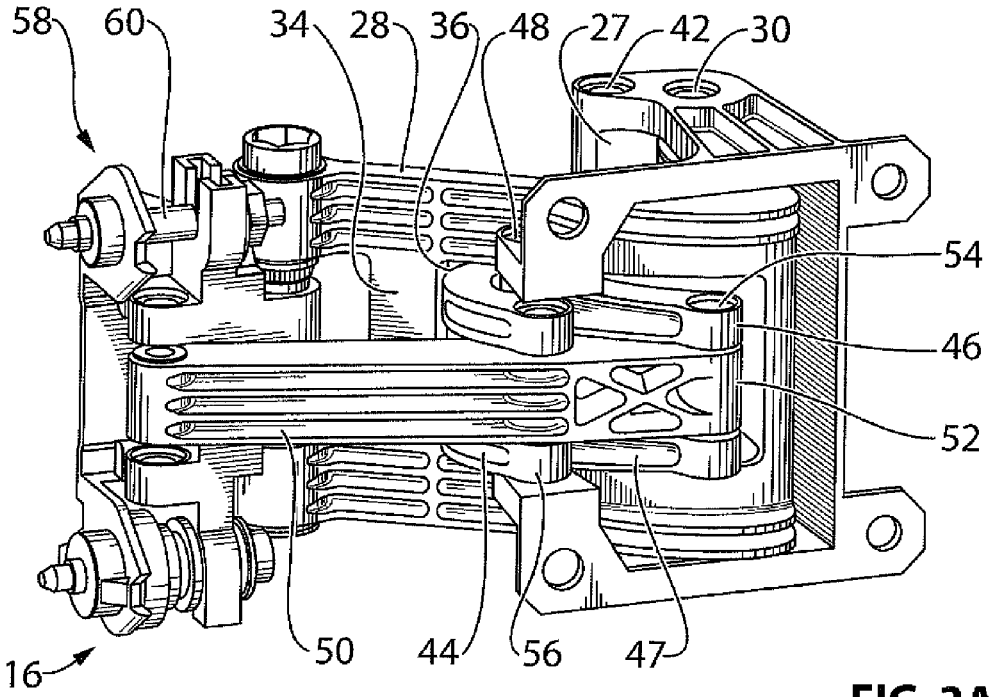
FIGS. 3A and 3B are perspective views of a hinge mounted to the vehicle door shown in FIGS. 1A-1C and 2A-2D.
Figure 3B:
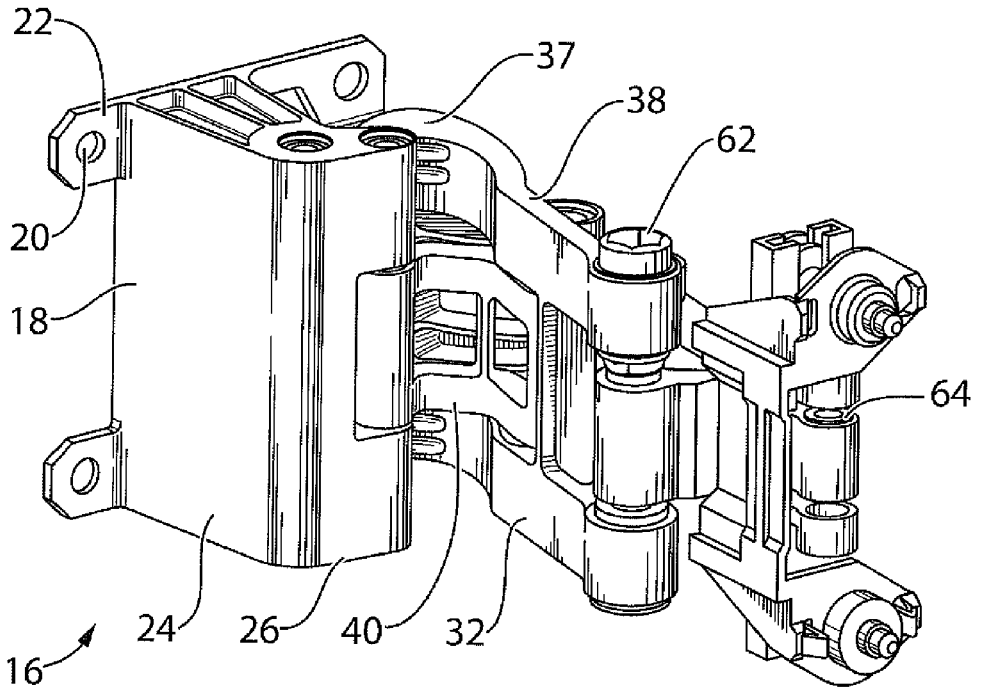
Figure 4B:
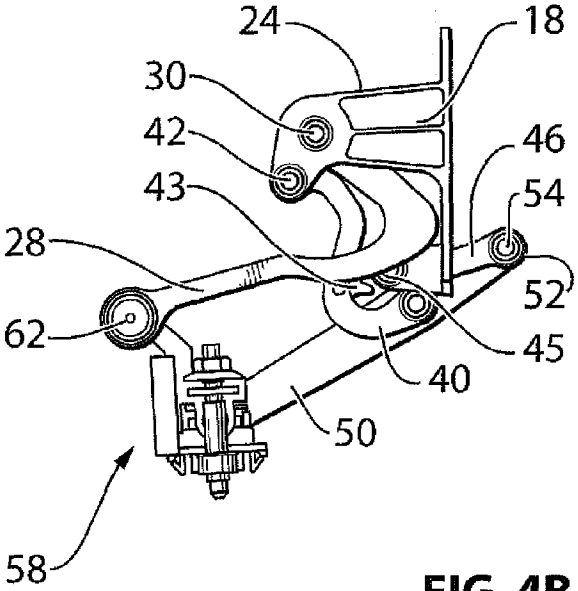
FIGS. 4A to 4D are top plan views of the hinge shown in FIGS. 3A and 3B in different positions of travel between the open and closed positions.
Figure 4D:
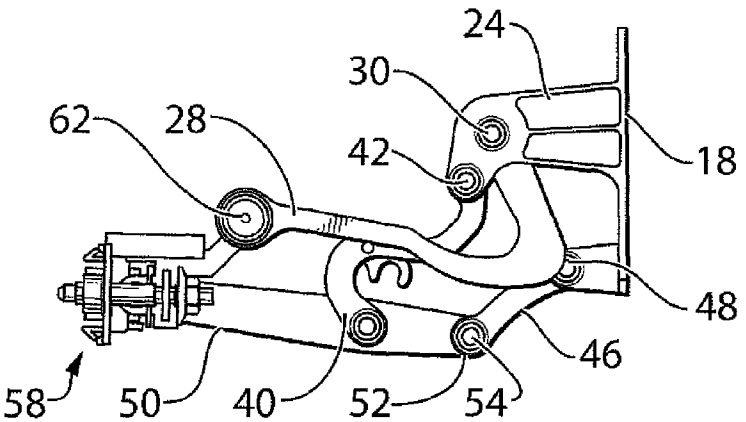
Figure 4A:
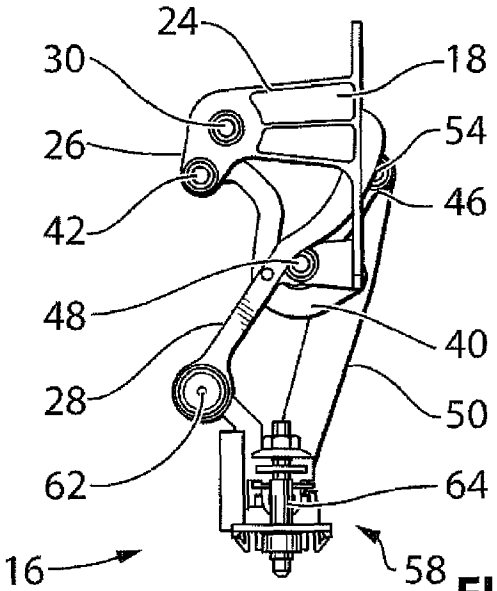
Figure 4C:
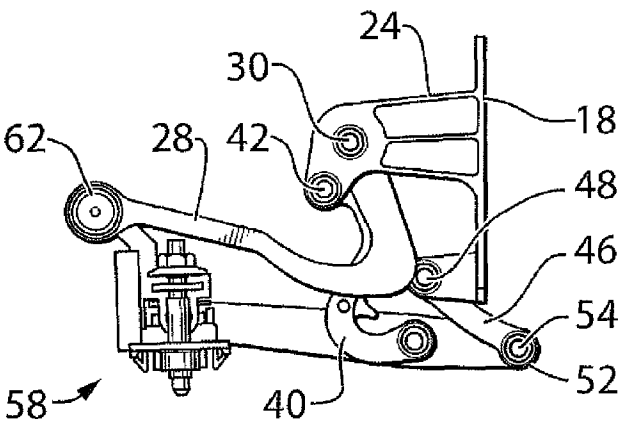

Once the front edge 66 is fully displaced away from vehicle body 10, door 12 begins to rotate around the movable sixth axis 62 (FIG. 2C, 4C) which is also fully displaced away from vehicle body 10, until the door reaches its fully open position (FIG. 2D, 4D). As outer bar 28 reaches its second position, i.e., its maximal pivot point (FIG. 4C), door bracket 58 begins to rotate around sixth axis 62 until it reaches its final position (4D). By translating front edge 66 away from vehicle body 10 before substantially beginning to pivot the door, greater clearance is provided and a wider range of cutlines for front edge 66 of door 12 are possible.

Figure 5:
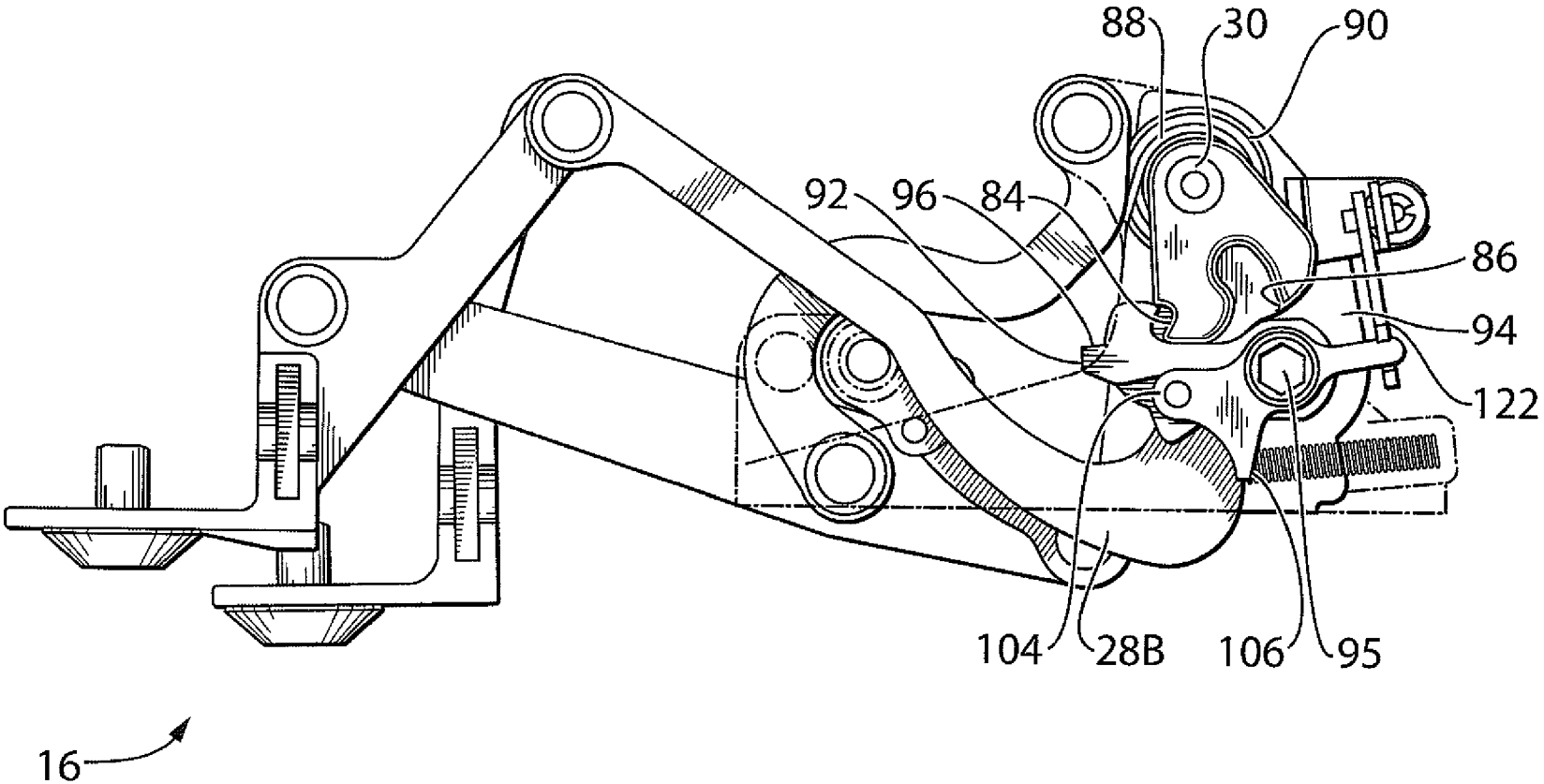
FIG. 5 is a top plan view of a second embodiment of the hinge having a latching mechanism with the mounting bracket shown in phantom.
Figure 6:
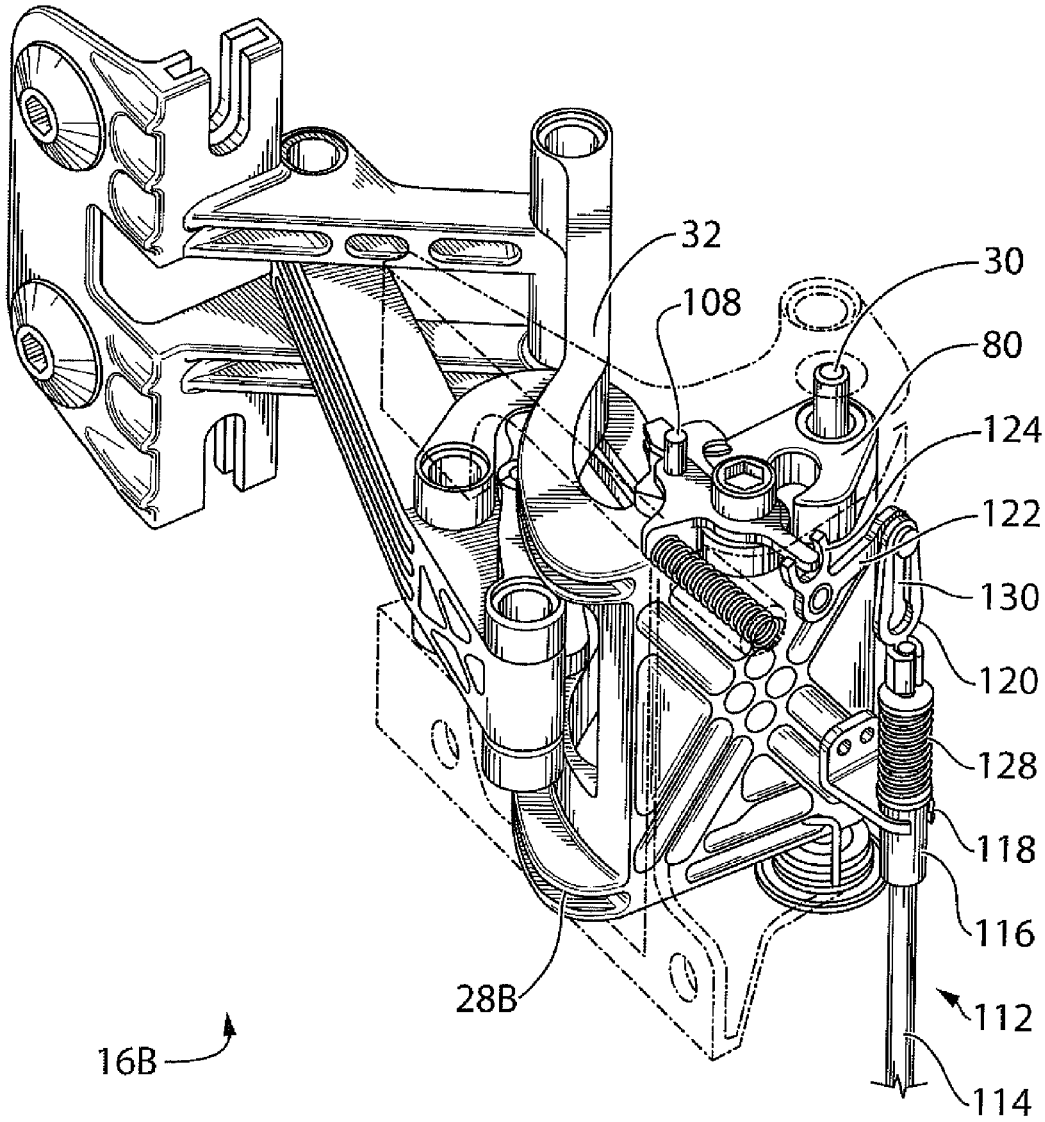
FIG. 6 is a perspective view of a portion of the hinge shown in FIG. 5 with the mounting bracket shown in phantom.
Figure 7:
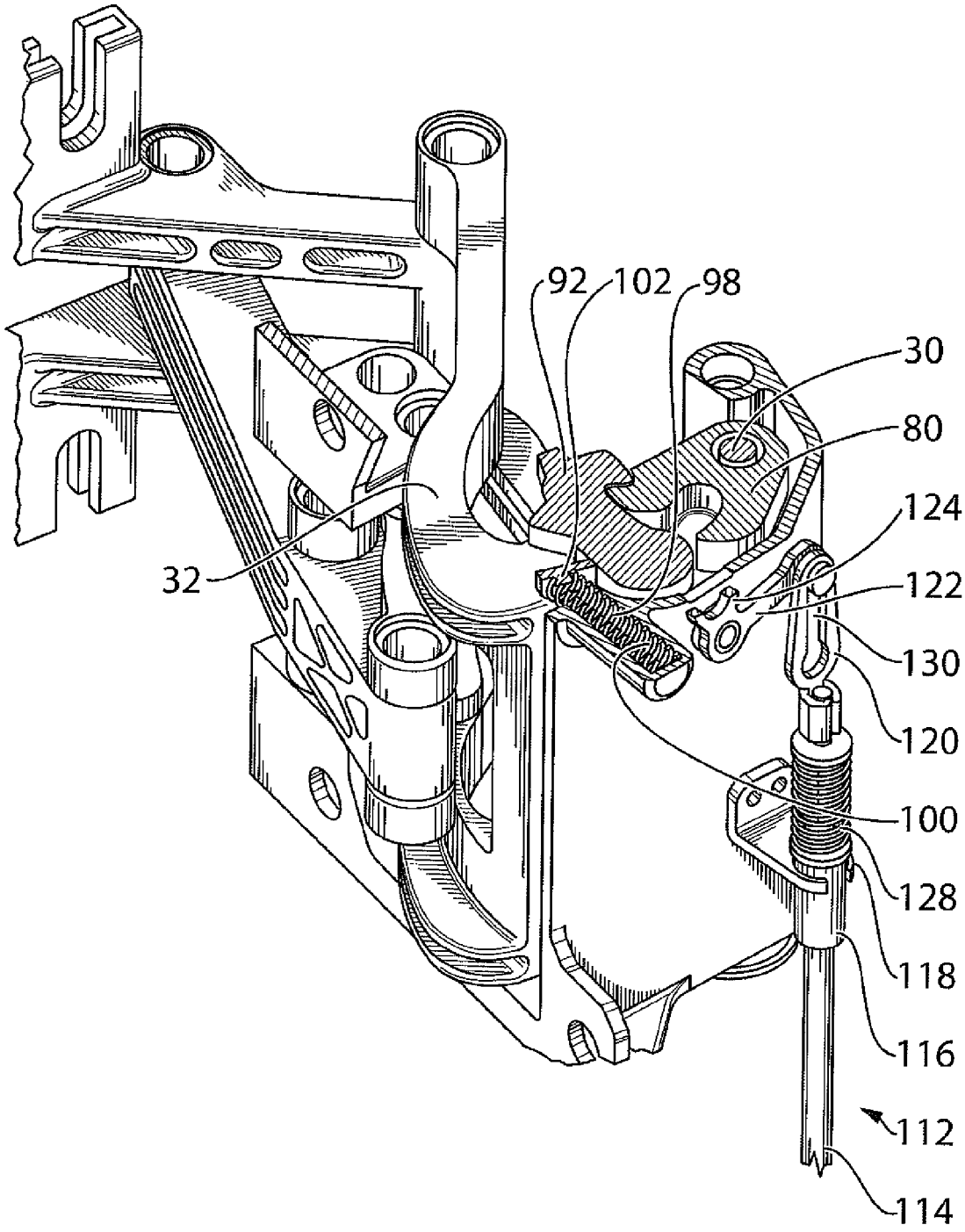
FIG. 7 is a cutaway perspective view of the hinge shown in FIGS. 5 and 6, featuring the ratchet and pawl retaining the hinge in the closed position.

In addition to increasing the number of aesthetic possibilities for the door, hinge 16 can provide security and cost-savings enhancements in that a conventional door latch can be omitted on the door 12. Instead, a latch to retain the door in the closed position can be mounted directly on the hinge. Referring now to FIGS. 5-7, second embodiment of the invention is shown generally at 16B. Hinge 16B substantially includes all the features of the hinge 16 described above, but includes additional latching capabilities. It also contains notably fewer components than a traditional automotive door latch. In addition, during a collision, accidental release of the latch will not open the door. Outer bar 28B includes a ratchet 80 integrally formed along a surface of one of the arms 32. Ratchet 80 includes a primary latching tooth 84 and a secondary latching tooth 86. As ratchet 80 is integrally formed from outer bar 28B, the two rotate around the fixed first axis 30 in tandem between a primary engaged position, a secondary position and a released position. A spring 88 is coaxially mounted on axis 30 around a post 90 in mounting bracket 18, and is operable to urge outer bar 28/ratchet 80 to the released position. While the currently-illustrated embodiment shows ratchet 80 being integrally formed from outer bar28B, those of skill in the art will recognize that the ratchet could be formed on a different link that is rotatably mounted to the housing.

A pawl 92 is pivotally mounted to a substrate 94 in mounting bracket 18 via a pawl rivet 95. Pawl 28 is movable between an "engaged" position where it abuts ratchet 80 and a released position, where it is rotated away from ratchet 80 to permit ratchet 80 to rotate towards the released position. A ratchet shoulder 96 on pawl 92 abuts primary latching tooth 84 on ratchet 80 when ratchet 80 is in its primary engagement position, preventing ratchet 80 from rotating towards the released position. Ratchet shoulder 96 abuts secondary tooth 86 when ratchet 80 is in its secondary engagement position, again preventing ratchet 80 from moving to the released position. A pawl spring 98 urges pawl 92 towards the engaged position (FIG. 5). One end of pawl spring 98 abuts a sidewall 100 of substrate 94, and the other end abuts a spring shoulder 102 on pawl 92. Rotating pawl 92 to the released position compresses pawl spring 98. While the currently-illustrated embodiment shows pawl 92 being pivotally mounted to mounting bracket 18, those of skill in the art will recognize that it can also be mounted to one of the different linkages that intersects the path of the link that holds the ratchet.

Pawl 92 is actuated by a release lever 104, which is pivotally mounted around pawl rivet 95 adjacent the pawl, and is movable between a "resting position" (shown in FIGS. 5 and 6) and an "actuated position", where it rotates away from ratchet 80. A depending tab 106 on release lever 104 abuts spring shoulder 102 (FIG. 6) on pawl 92 opposite pawl spring 98 so that moving release lever 104 to its actuated position also actuates pawl 92. Pawl spring 98 thus biases both release lever 104 and pawl 92 towards their resting positions. A post 108 extending out from release lever 104 is located in a slot 110 in the housing, thereby limiting the range of motion of release lever 104.

Release lever 104 is actuated by the actuation of cable 112, which is kinematically coupled to a release mechanism, either powered or manual, such as an actuator, a shaped memory alloy actuator, or the manually-operated inside and outside door handles (none shown). In the presently-illustrated embodiment, cable 112 is connected to a shaped memory alloy actuator (not shown). While the presently-illustrated embodiment uses a cable to actuate release lever 104, a rod could also be used. Cable 112 is protected in a sheathing 114 that terminates in a bushing 116. Bushing 116 is mounted to latch 16D) via a bracket 118. Cable 112 terminates in a clip 120 that is mounted to an auxiliary release lever 122. Auxiliary release lever 122 includes a claw 124 that is mounted around an arm 126 on release lever 104. Thus, actuating cable 112 causes auxiliary release lever 122 to pivot, which in turn rotates release lever 104 to the actuated position. A shaped memory alloy return spring 128 coaxially located around cable 112 between bushing 116 and clip 120 returns the cable to its resting length upon release. Spring 128 can be omitted when other types of actuators are used. A slot 130 is provided in clip 120 and acts as a lost motion coupling so that the return of release lever 104 to its resting position does not move cable 112.

Since the latch is located directly on the hinge 16B rather than on a rearward door edge, the inertial loads placed upon the latch are greatly reduced, and thus, a much lighter latch can be used than with a conventional door design. The latch must merely be sized as to prevent accidental pivoting of the hinge. For additional security, door 12 can be adapted so that it cannot be rotated open until its pivot point (i.e., sixth axis 62) is moved forward of sidewall 19. For example, plungers (not shown) may be provided along a rearward door edge 134 (FIGS. 2A-D). These studs can interface with apertures (also not shown) A spring can be provided along the plunger to aid in the opening of the door located along a pillar 136 in vehicle body 10. As door 12 moves forward (FIG. 1B), the studs clear the pillar 136, allowing door 12 to be freely rotated away from the vehicle body 10. Furthermore, as an additional benefit, weatherproofing of the hinge-mounted latch is easier to achieve than in a conventional latch which must provide a opening for a striker bar that is mounted to the vehicle frame.

While the embodiments discussed herein are directed specific embodiments of the invention, it will be understood that combinations, sub-stets and variations of the embodiments of the invention are within the scope of the invention which is defined solely by the claims.

What is claimed is:

1. A hinge for a vehicle door that is movable between a closed and a fully open position relative to a vehicle body, the hinge comprising:

a mounting bracket, operable to be secured to the vehicle body;

at least one link, pivotally mounted along a fixed axis to the mounting bracket at a first end and operable to pivot a second end of the at least one link between a first and second position, wherein the at least one link includes an outer bar pivotally mounted at a first end to the mounting bracket along the fixed axis and directly to the door bracket along the movable axis at a second end;

a door bracket, operable to be secured to the vehicle door, and pivotally mounted along a movable axis to the second end of the at least one link; and wherein the vehicle door is constrained by the vehicle body from pivoting around the movable axis when the second end of the at least one link is in the first position, and is operable to pivot around the movable axis when the at least one link is in the second position, wherein the hinge further comprises a latch including a ratchet and pawl, wherein the ratchet is mounted to a link from the at least one link, wherein the ratchet is pivotable about the fixed axis between a ratchet engagement position and a ratchet released position, wherein the ratchet is connected to the at least one link in such a way that if the ratchet is constrained in the ratchet engagement position the at least one link is constrained in the first position, and wherein the pawl is pivotable between a pawl engagement position wherein the pawl engages the ratchet and prevents the ratchet from pivoting about the fixed axis so as to lock the at least one link in the first position, and a pawl released position wherein the pawl permits the ratchet to pivot about the fixed axis to the ratchet released position, thereby permitting the at least one link to pivot away from the first position.

2. The hinge of claim 1, wherein the outer bar includes two parallel arms spaced apart.

3. The hinge of claim 2, wherein each arm of the outer bar includes a first segment proximate the first end and a second segment subtended to the first segment proximate the second end.

4. The hinge of claim 3, wherein the at least one link further includes:

a link bar pivotally connected to the mounting bracket at a first end along an additional fixed axis that is displaced away from the fixed axis; and an auxiliary link bar pivotally connected to a second end of the link bar and to the door brackets along movable axes.

5. The hinge of claim 4, wherein the at least one link further includes an inner bar that is pivotally mounted at a first end to an additional axis on the mounting bracket and at a second end to the auxiliary link bar along a movable axis that is located between the first and second ends of the auxiliary link bar.

6. The hinge of claim 5, wherein the inner bar extends between the two parallel arms of the outer bar.

7. The hinge of claim 6, further including a clasp provided on the inner bar, the clasp operable to retain a mounting post on the mounting bracket when the hinge is in the closed position.

8. The hinge of claim 1, wherein the hinge is operable to retain the door in the closed position upon accidental release of the latch during a collision.

9. The hinge of claim 1, wherein the ratchet is a raised surface integrally formed on one of the at least one links.

10. The hinge of claim 9, wherein the ratchet is a raised surface integrally formed from the outer bar.

11. The hinge of claim 10, wherein the pawl is mounted to another link of the at least one link than the one link where the ratchet is formed.

12. The hinge of claim 1, wherein the ratchet and pawl are cooperatively movable to a secondary engagement position operable to retain the hinge between the closed position and the open position.

13. The hinge of claim 1, wherein the latch further includes a release lever pivotally mounted to the housing and kinematically coupled with the pawl.

14. A hinge for a vehicle door that is movable between a closed and a fully open position relative to a vehicle body, the hinge comprising a mounting bracket, operable to be secured to the vehicle body;

at least one link pivotally mounted along a fixed axis to the mounting bracket at a first end and operable to pivot a second end of the at least one link between a first and second position;

a door bracket, operable to be secured to the vehicle door, and pivotally mounted along a movable axis to the second end of the at least one link; and a latch including a ratchet and pawl, wherein the ratchet is mounted to a link from the at least one link, wherein the ratchet is pivotable about the fixed axis between a ratchet engagement position and a ratchet released position, wherein the ratchet is connected to the at least one link in such a way that if the ratchet is constrained in the ratchet engagement position the at least one link is constrained in the first position, and wherein the pawl is pivotable between a pawl engagement position wherein the pawl engages the ratchet and prevents the ratchet from pivoting about the fixed axis so as to lock the at least one link in the first position, and a pawl released position wherein the pawl permits the ratchet to pivot about the fixed axis to the ratchet released position, thereby permitting the at least one link to pivot away from the first position.

15. A hinge for a vehicle door that is movable between a closed and a fully open position relative to a vehicle body, the hinge comprising:

a mounting bracket, operable to be secured to the vehicle body;

at least one link, pivotally mounted along a fixed axis to the mounting bracket at a first end and operable to pivot a second end of the at least one link between a first and second position; and a door bracket, operable to be secured to the vehicle door, and pivotally mounted along a movable axis to the second end of the at least one link;

wherein the at least one link is movable between a first position wherein the vehicle body prevents rotation of the door bracket about the movable axis and a second position wherein the vehicle body permits rotation of the door bracket about the movable axis, and the vehicle door is holdable in a substantially constant orientation with respect to the mounting bracket throughout a range of motion of the at least one link between the first position and the second position, wherein the hinge further comprises a latch including a ratchet and pawl, wherein the ratchet is mounted to a link from the at least one link, wherein the ratchet is pivotable about the fixed axis between a ratchet engagement position and a ratchet released position, wherein the ratchet is connected to the at least one link in such a way that if the ratchet is constrained in the ratchet engagement position the at least one link is constrained in the first position, and wherein the pawl is pivotable between a pawl engagement position wherein the pawl engages the ratchet and prevents the ratchet from pivoting about the fixed axis so as to lock the at least one link in the first position, and a pawl released position wherein the pawl permits the ratchet to pivot about the fixed axis to the ratchet released position, thereby permitting the at least one link to pivot away from the first position.

16. The hinge of claim 1, wherein movement of the at least one link to the second position causes the vehicle door to be pivotable around the movable axis.

* * * * *